United States Patent [19]

Hulcombe

[11] 4,314,433

[45] Feb. 9, 1982

[54] ROOF TILE FIXING CLIP

[75] Inventor: Barry J. Hulcombe, Brisbane, Australia

[73] Assignee: Monier Colourtile Pty. Ltd., Darra, Australia

[21] Appl. No.: 92,043

[22] Filed: Nov. 7, 1979

[30] Foreign Application Priority Data

Nov. 13, 1978 [AU] Australia ..... PD6736

[51] Int. Cl.[3] ..... E04D 1/34

[52] U.S. Cl. ..... 52/521; 52/547; 52/748

[58] Field of Search ..... 52/520, 521, 547–551, 52/278, 489, 543, 544, 747, 748; 248/222.4, 223.1, 225.1

[56] References Cited

U.S. PATENT DOCUMENTS

| | | | |
|---|---|---|---|
| 668,625 | 2/1901 | Connor | 52/548 |
| 1,517,429 | 12/1924 | Jensvold | 248/222.4 |
| 1,544,391 | 6/1925 | Harward et al. | 52/547 |
| 1,788,481 | 1/1931 | Brostrom | 52/365 |
| 2,279,943 | 4/1942 | Hayes et al. | 52/547 |
| 3,209,503 | 10/1965 | Mostoller | 52/547 |
| 3,477,684 | 11/1969 | Dagiel | 52/489 |
| 4,047,353 | 9/1977 | Aarons | 52/489 |
| 4,141,191 | 2/1979 | Aarons | 52/545 |
| 4,182,090 | 1/1980 | Aarons | 52/278 |

FOREIGN PATENT DOCUMENTS

| | | | |
|---|---|---|---|
| 551225 | 2/1943 | United Kingdom | 52/520 |

*Primary Examiner*—James L. Ridgill, Jr.

*Attorney, Agent, or Firm*—Schwartz, Jeffery, Schwaab, Mack, Blumenthal & Koch

[57] ABSTRACT

The invention relates to a method of fixing roofing tiles to a roof structure. This method includes the steps of laying a lower tile on a tiling batten, passing a fastener through a preformed hole in the lower tile and engaging the batten, laying an upper tile on the lower tile in overlapping arrangement and finally connecting the upper tile to the fastener by a suitable clip.

The invention also provides a roofing tile fixing clip for securing overlapping roofing tiles to a roofing structure. The clip includes a body portion, a foot adapted to engage a fastener secured to the building structure, and a hook to engage the upper tile of the overlapped tiles.

7 Claims, 8 Drawing Figures

10
11
12
13
14
15
16
17
18
19
20
21
22
23

ROOF TILE FIXING CLIP

BACKGROUND OF THE INVENTION (1) Field of the Invention

This invention relates to a method of fixing roofing tiles to a roofing structure, and a clip suitable for such method.

(2) Description of the Prior Art

In areas where tile clipping methods are not used, the nailing of tiles through preformed punched holes in the tiles is a common practice.

It has been found that the practice of nailing tiles only, is unsatisfactory under high wind conditions to prevent lifting of the nose end of the upper tile under wind suction. This will occur even if every tile is nailed rather than the standard practice of nailing every second or third tile.

BRIEF SUMMARY OF THE INVENTION

An object of the present invention is to provide a method of fixing the tiles where the tendency for the nose end to lift is eliminated, or at least, markedly reduced.

A further object of the present invention is to provide a roof tile fixing clip suitable for this method.

A preferred object is to provide a method which is concealed from external view and can be used to attach most variable shapes of tiles of the interlocking type. Other objects of the invention will become apparent to the skilled addressee from the following description.

In one aspect the invention resides in a method of fixing roofing tiles to a roof structure including the steps of:

(a) laying a lower tile on a tiling batten;

(b) passing a fastener through a preformed hole in said lower tile and engaging the batten;

(c) laying an upper tile on said lower tile in an overlapping arrangement; and (d) connecting aid upper tile to said fastener by a clip means.

In another aspect, the invention resides in a roofing tile fixing clip for securing overlapping roofing tiles to a roofing structure including:

a body;

a foot adapted to engage a fastener secured to the building structure; and hook means to engage the upper tile of the overlapped tiles.

Preferably the lower tile has a preformed hole therethrough through which the fastener passes. The fastener may be a nail (preferably a deformed shank nail), or a screw. Preferably the foot is fitted between the upper surface of the lower tile and the underside of the head of the fastener. Preferably, the foot lies in a preformed depression in the upper surface of the lower tile. Preferably a slot is provided in the foot, which preferably is open at the junction of the foot and body, the sides of the slot engaging the shank of the fastener. Preferably the hook means engages a lower side portion of the upper tile.

In a third aspect the invention resides in a roof structure wherein the tiles are secured thereto by the clip hereinbefore described.

BRIEF DESCRIPTION OF SEVERAL VIEWS OF THE DRAWINGS

To enable the invention to be fully understood, a preferred embodiment will now be described with reference to the accompanying drawings, wherein.

DETAILED DESCRIPTION OF THE PREFERRED EMBODIMENT

Figures 1, 2, 3:
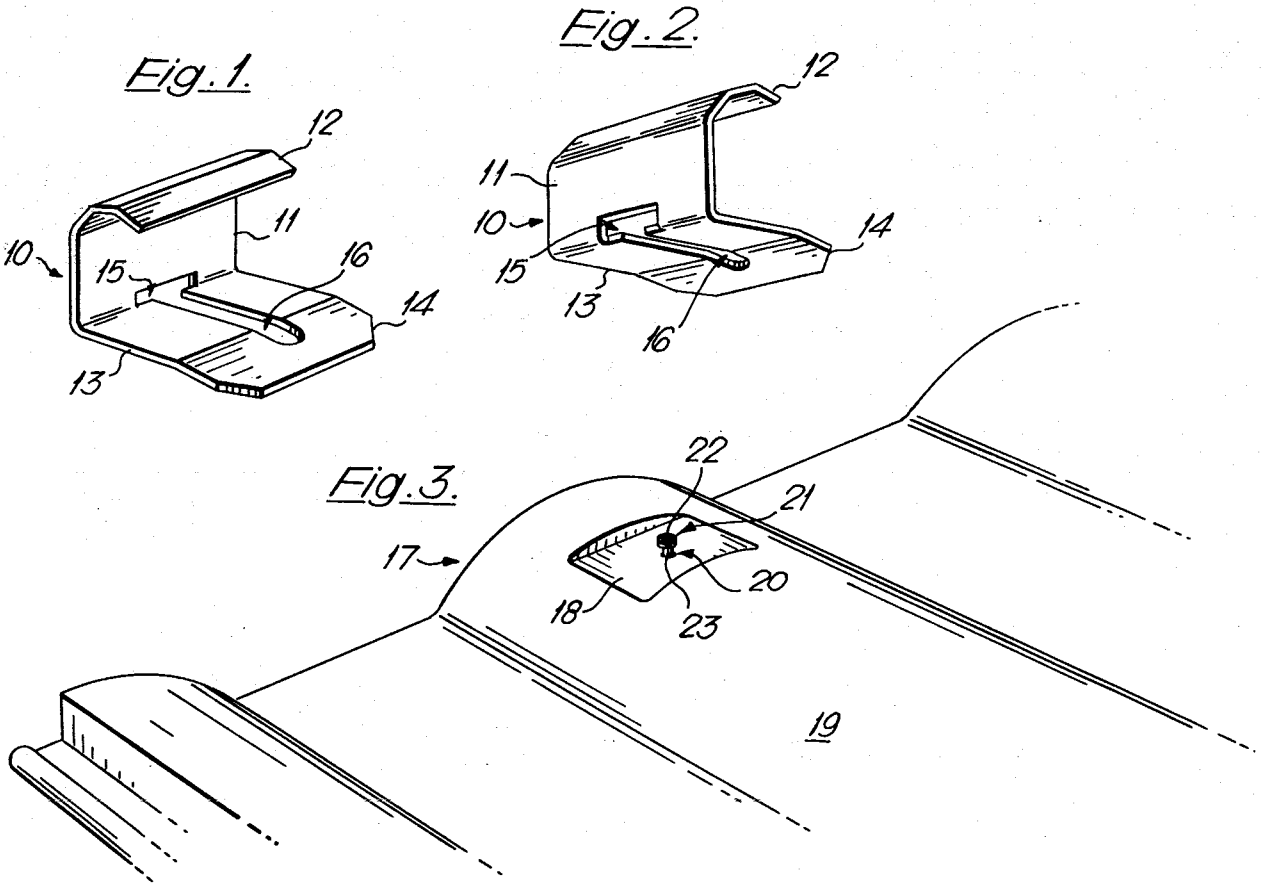
FIGS. 1 and 2 are isometric views of one form of the clip.
FIG. 3 shows the lower tile and fastener before the upper tile and clip are fitted.

Referring to FIGS. 1 and 2, the clip 10 is formed from a flat strip of metal or is moulded from suitable plastics-material. The clip has a flat, substantially rigid body 11, which is terminated at its normally upper end by a downwardly-directed integral hook 12. The body 11 is terminated at its normally lower end by a substantially perpendicular foot 13 which has a downwardly directed lip 14. A substantially rectangular aperture 15 is formed in the lower part of the body 11. A slot 16 is formed in the foot 13 and lip 14 and is open to the aperture at the junction of the body 11 and foot 12. The width of the slot 16 is selected to slidably receive the shank of the fastener with which it is to be used.

As shown in FIG. 3, the lower tile 17 has a preformed depression 18 on the upper surface of one of the ribs 19. A preformed hole 20 passes through the tile 17 and is substantially centred on the depression 18. The lower tile 17 lies on the tiling batten (not shown). A ring shank nail 21, having a head 22, has its shank 23 passing through the hole 20 in the tile 17 and penetrating the tiling batten.

Figure 4:
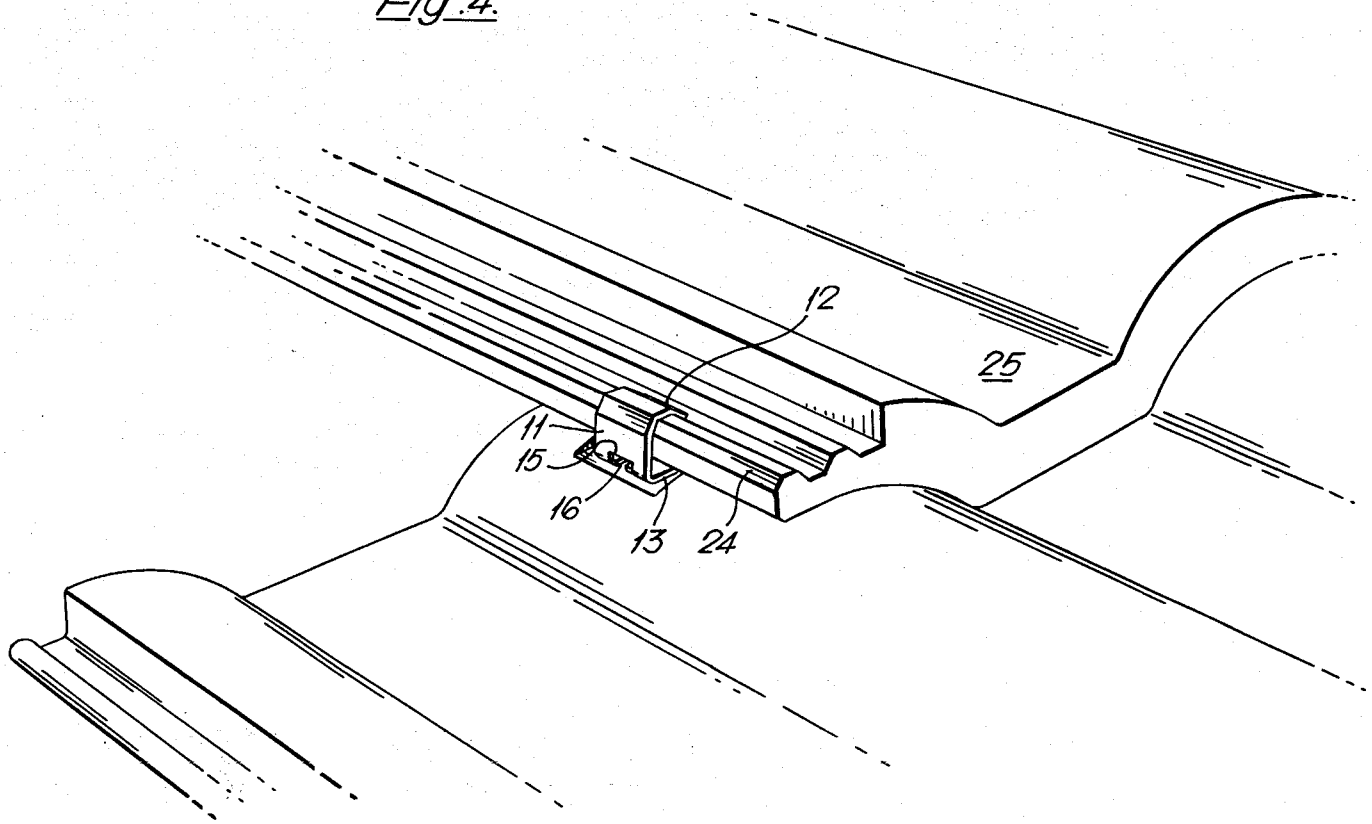
FIG. 4 shows the completed assembly.

Turning to FIG. 4, the clip 10 is engaged on the nail 21, the shank 23 of nail 21 engaged in the slot 16 and the head 22 overlying the foot 13 and/or the lip 14 of the clip 10. The aperture 15 is dimensioned to allow the head 22 to pass therethrough. The hook 12 is engaged over the lower edge 24 of the upper tile 25, adjacent the nose end thereof, which overlaps the lower tile 17.

As can be easily seen, the method of the fixing of the clip 10 to the tiling batten by the nail 21 is concealed from external view.

The method of securing the tiles will now be described.

The roof fixer commences laying the tiles in the normal manner, course for course, attaching each lower tile with the ring shank nail 21 through the hole 20 in the tile and penetrating the timber or metal tiling batten. (When metal tiling battens are used, a self drilling screw may be used in place of the nail, provided the head of the screw is not touching the tile and leaves sufficient room for attachment of the clip foot).

As the fixer spreads the next course of tiles, he attaches a clip 10 to the protruding nail of the lower course, engaging the shank 23 in the slot 16, and positions the edge 24 of the upper tile under the hook 12 of the clip. The slot 16 allows the fixer to move the clip 10 laterally relative to the nail 21 to enable the courses of tiles to be aligned. This method is repeated throughout the roof.

Figure 5:
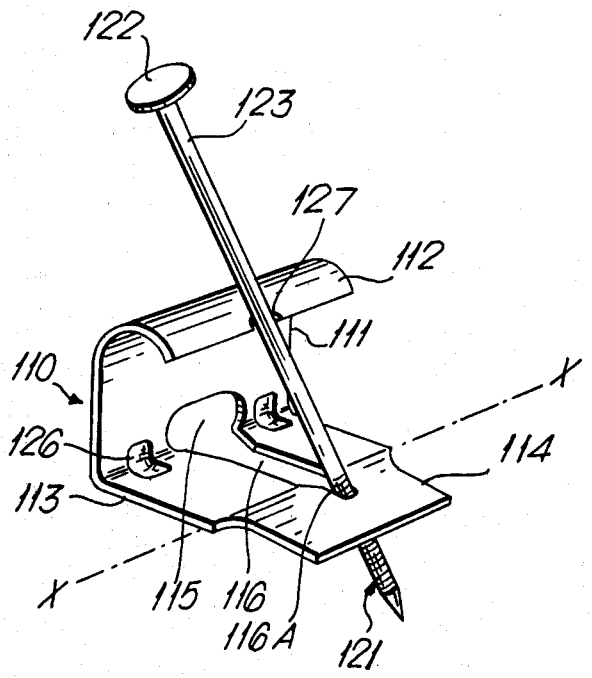
FIGS. 5 and 6 are isometric views of a second form of the clip.
Figure 6:
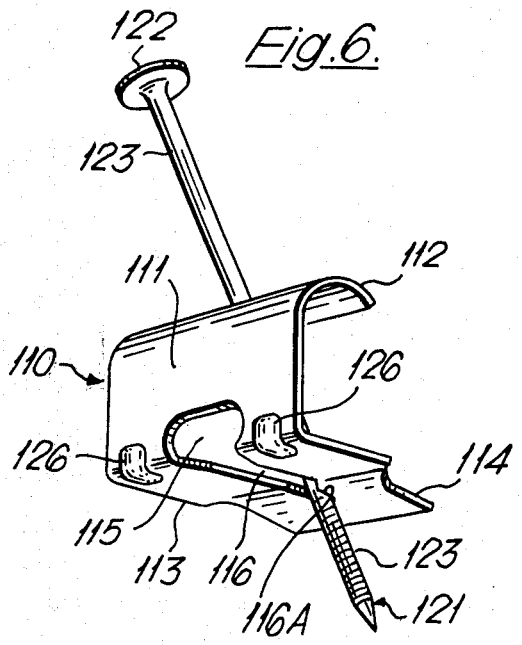

FIGS. 5 and 6 show aa modified from of the clip of FIGS. 1-4, like components having the numeral "1" inserted before the corresponding identification numerals in FIGS. 1-4.

Aperture 115 is substantially semi-circular to provide additional clearance for the head 122 of nail 121.

The slot 116 is selectively tapered forwardly of the line X—X to slidably receive and hold captive the shank of the nail 121 which is used to secure the clip.

Strengthening ribs 126 are provided at the junction of the body 111 and the foot 113. The deformed shank 123 of nail 121 is held captive in the clip by the reduced section 116A of the slot 116 and by the recess 127 formed in the forward edge of the hook 112.

Figure 7:
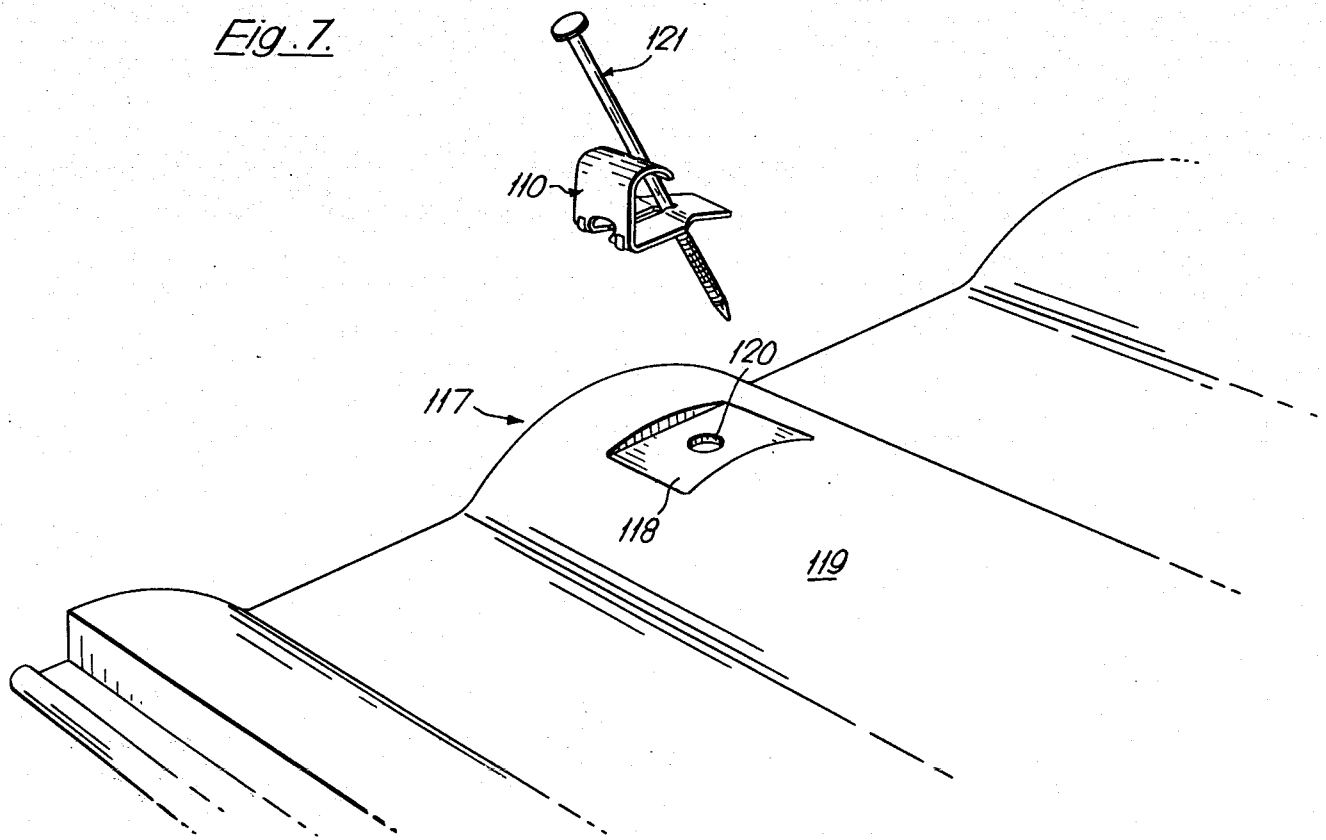
FIG. 7 shows the clip and lower tile prior to fixing the clip to a batten.
Figure 8:
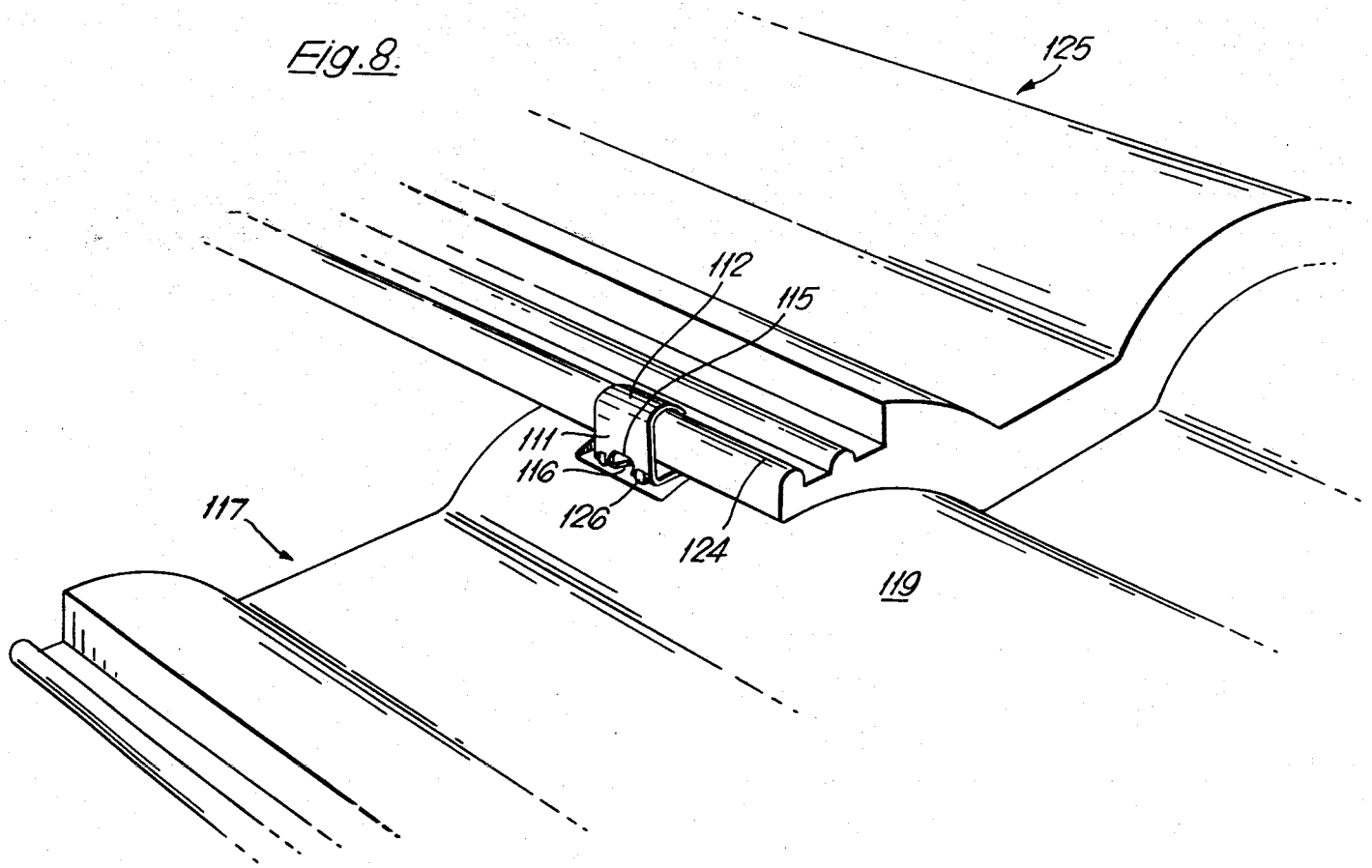
FIG. 8 shows the completed assembly using this second form of clip.

Referring to FIG. 7, the captive nail 121 of the clip 110 is nailed through the hole 120 of lower tile 119 and engaged in the timber or metal batten (not shown). In the process the captive nail 121 will become dislodged from the captive point 116A and 127 and allows the shank 123 of the nail to move within the slot 116. The aperture 115 is dimensioned to allow the head 122 to pass therethrough if required. The hook 112 is engaged over the lower edge 124 of the upper tile 125 as hereinbefore described.

Where it has previously been impractical to clip small sections of tile in the areas such as hips or valleys, due to the restriction of space for clip attachment, this clip can be used, providing there is a batten located below the desirable fixing point. Should the preformed nail hole be missing then the fixer need only drill the tile and attach the nail and clip in the manner previously described.

It is considered that this clip is simpler to attach than other clipping methods, more economical to produce both in material and shape and in particular the labour cost to install.

The advantages of the described preferred embodiment of this invention are as follows:

1. The clip utilises the preformed nail hole which is common to all product productions.

2. Roof fixers who are experienced in fixing tiles by nailing will find this technique is compatible with their traditional method.

3. The attachment of the clip to the nail is quick and simple.

4. The fact that the nail and clip is fixed from above the roof, almost every possible tile can be fixed, whereas other clipping systems which are attached to the upper edge of tiling battens have a restriction when space to hammer the clip is limited.

5. The slotted base of the clip assures a flexibility, not available to other systems, which enables the sideways movement of tiles to preserve straight lines when laying the tiles.

6. With the base of the clip attached to the nail, through the lower tile, and the upper tile hooked under the hook in the top of the clip, both tiles are sandwiched to the tiling batten thus increasing their stability under lift off due to wind suctions.

7. When wind forces occur, creating uplight suctions, the load transmitted to the clip hook by the upper tile causes a downward force on the foot of the clip (as it pivots around the fastener head) which is thus transferred to the lower tile. This behaviour pattern has been observed during cyclic loading testing to the equivalent of cyclonic forces.

8. The additional feature of a flat depression in the tile in the area of the prepunched nail hole assures the proper location of the clip as the nail cannot be driven home to prevent the clip sliding under the nail head. The amount of nail rising above the surface of the tile is not critical, under test loads. Any excessive slack is taken up by the preload curvature of the base of the clip.

9. The clip is ideally suited to roofing applications where roof rafters are covered with solid decking, plywood or similar. Other clip systems which employ a nail into the top edge of the batten are difficult to apply due to the restricted space caused by the surface of the decking.

10. The width of the clip can be chosen to distribute the loads to the edge of the tile more evenly than other narrow type clips which can cause stress points on that portion of a tile which is very thin. In addition, each tile is fixed at two points.

11. During heavy rain, any rain running off the upper tile down the clip will run away on the lower tile and will not run between tthe tiles due to capillary action, protecting the tiling batten from water damage.

Various changes and modifications may be made to the arrangements described without departing from the scope of the present invention.

I claim:

1. A method of fixing sequentially mounted lower and upper roofing tiles to a roof structure including the steps of:

(a) laying a lower tile on a tiling batten;

(b) passing a fastener having a head and a shank through an aperture in the lower tile attaching the lower tile to the tiling batten, spacing the head of said fastener above the upper face of the lower tile and associating said head with a clip having a body, foot and hook means engaging an upper tile overlapping said lower tile providing, said foot with a slot through which the shank of the fastener is passed when the lower tile is attached to the tiling batten, communicating said slot with an aperture in the body providing clearance for the passing of the head of the fastener;

(c) attaching the lower tile to the tiling batten by fastening said fastener to the batten whereby the head of the fastener abuts said slot of said clip; and (d) engaging said upper tile with the hook means of said clip.

2. A method as claimed in claim 1 wherein the fastener is passed through the aperture in the lower tile and fixed to the tiling batten prior to the clip being attached to the fastener by passing the head of the fastener through the aperture in the body so that the clip is attached to the lower tile.

3. A method as claimed in claim 1 wherein the fastener is held captive in the clip before the fastener is passed through the lower tile.

4. An integral roofing tile fixing clip for securing overlapping roof tiles to a roofing structure including:

a body portion;

a foot portion offset from the plane of the body portion and having an elongate slot therein which is open to the junction of the body portion and communicates with an aperture in the adjacent part of the body portion, which aperture is adapted to receive the head of a fastener, and wherein the shank of the fastener may pass through the slot and thereby attach a lower tile to a tiling batten; and a hooking flange on the body portion adapted to engage with an upper tile which overlaps with the lower tile.

5. A roofing tile clip as claimed in claim 13 wherein the slot in the foot portion of the clip is provided with an inwardly tapering portion remote from the body portion so as to receive the shank of said fastener in a captive manner.

6. A roofing structure including:

a tiling batten;

a lower tile supported on the batten;

an upper tile having a portion overlying the lower tile;

a fastener having a head and a shank; and an integral roofing tile clip interconnecting the upper tile with the lower tile, said clip having a body portion, a foot portion offset from the plane of the body portion and having an elongate slot therein which communicates with an aperture in an adjacent lower part of the body portion, which aperture is adapted to slidably receive the head of the fastener which passes through the slot and attaches the lower tile to the tiling batten; said clip further including a hooking flange adaped to engage with said upper tile.

7. A roofing structure as claimed in claim 6 wherein the upper face of the lower tile contains a cavity and wherein the foot portion of the clip is engaged within the cavity.

* * * * *